US008007126B2

(12) United States Patent
Hemby

(10) Patent No.: US 8,007,126 B2
(45) Date of Patent: Aug. 30, 2011

(54) LIGHT HOUSING INCLUDING CAMERA

(75) Inventor: William Hemby, Baltimore, MD (US)

(73) Assignee: Halorion Lighting and Security Systems, LLC, Baltimore, MD (US)

( * ) Notice: Subject to any disclaimer, the term of this patent is extended or adjusted under 35 U.S.C. 154(b) by 9 days.

(21) Appl. No.: 12/267,839

(22) Filed: Nov. 10, 2008

(65) Prior Publication Data

US 2010/0118533 A1 May 13, 2010

(51) Int. Cl.
*F21V 15/01* (2006.01)
*F21V 13/04* (2006.01)
*F21V 21/08* (2006.01)

(52) U.S. Cl. .... 362/240; 362/244; 362/245; 362/249.14

(58) Field of Classification Search ..... 362/249.01–249.19, 35, 245, 800, 362/240, 238, 244, 11, 249.02, 249.06, 249.11, 362/145, 102
See application file for complete search history.

(56) References Cited

U.S. PATENT DOCUMENTS

| | | | | |
|---|---|---|---|---|
| 1,575,571 | A * | 3/1926 | Gray | 362/249.14 |
| 4,866,285 | A * | 9/1989 | Simms | 250/495.1 |
| 4,982,092 | A | 1/1991 | Jehle | |
| 5,010,412 | A * | 4/1991 | Garriss | 348/371 |
| 5,701,015 | A * | 12/1997 | Lungershausen et al. | 250/495.1 |
| 6,449,103 | B1 | 9/2002 | Charles | |
| 6,491,417 | B1 * | 12/2002 | Haen et al. | 362/485 |
| 6,572,249 | B2 * | 6/2003 | Bailey | 362/473 |
| 6,679,618 | B1 | 1/2004 | Suckow et al. | |
| 6,682,204 | B2 * | 1/2004 | Mullally et al. | 362/235 |
| 6,812,970 | B1 * | 11/2004 | McBride | 348/372 |
| 6,824,283 | B2 * | 11/2004 | Pohlert et al. | 362/11 |
| 6,905,228 | B1 * | 6/2005 | Takeyasu et al. | 362/237 |
| 6,912,007 | B2 * | 6/2005 | Gin | 348/373 |
| 7,136,582 | B2 * | 11/2006 | Hayami et al. | 396/182 |
| 7,226,178 | B2 * | 6/2007 | Upmeyer | 362/11 |
| 7,290,893 | B2 * | 11/2007 | Amphlett | 362/11 |
| 7,330,649 | B2 * | 2/2008 | Finizio et al. | 396/146 |
| 7,331,684 | B2 * | 2/2008 | Tung | 362/102 |
| 7,344,273 | B2 * | 3/2008 | Lewis et al. | 362/233 |
| 7,357,530 | B2 * | 4/2008 | Wang et al. | 362/249.01 |
| 7,378,983 | B2 * | 5/2008 | Wang et al. | 340/815.45 |
| 7,401,936 | B1 * | 7/2008 | Fan | 362/102 |
| 7,651,281 | B2 * | 1/2010 | Wen | 396/427 |
| 7,663,692 | B2 * | 2/2010 | Chang | 348/372 |
| 7,695,153 | B2 * | 4/2010 | Tsai | 362/102 |
| 7,731,383 | B2 * | 6/2010 | Myer | 362/145 |

(Continued)

FOREIGN PATENT DOCUMENTS

GB 2431776 A * 5/2007

(Continued)

*Primary Examiner* — Ismael Negron
(74) *Attorney, Agent, or Firm* — Sughrue Mion, PLLC

(57) ABSTRACT

A housing including a plurality of light emitting elements respectively positioned within plurality of discrete housing modules, each housing module forming an inside chamber and being disposed on a perimeter of the housing along a horizontal plane directed outwardly. The light emitting elements directing the generated light outwardly and generally downwardly. The chambers include a lens for directing the generated light. The light emitting apparatus may be attached to a structure such as a light pole, a wall, or a ceiling. The light emitting apparatus may have a hollow center to enclose the surveillance camera, and may also have an opening at the bottom, covered by a transparent cover, through which the camera may capture images of the outside of the apparatus.

20 Claims, 4 Drawing Sheets

U.S. PATENT DOCUMENTS

2004/0095777 A1* 5/2004 Trenchard et al. ..... 362/477
2005/0117326 A1* 6/2005 Ma ..... 362/102
2005/0168617 A1* 8/2005 Timm et al. ..... 348/335
2007/0080306 A1* 4/2007 Lin ..... 250/493.1
2007/0081331 A1* 4/2007 Wang ..... 362/250
2008/0151052 A1* 6/2008 Erel et al. ..... 348/143
2008/0192492 A1 8/2008 Chen
2008/0212317 A1 9/2008 Barozzini et al.
2008/0232104 A1 9/2008 Freeman et al.
2008/0266393 A1* 10/2008 Park ..... 348/143
2009/0002986 A1 1/2009 Medendorp, Jr. et al.
2009/0196593 A1* 8/2009 Cheng ..... 396/155

FOREIGN PATENT DOCUMENTS

JP 2000188706 A * 7/2000
JP 2004159253 A * 6/2004

* cited by examiner

LIGHT HOUSING INCLUDING CAMERA

BACKGROUND OF THE INVENTION

Two different, but not inconsistent topics of the discussion herein are providing illumination to medium to large spaces, such as conference centers, streets, highways, and the like, and also providing surveillance of such spaces.

In a conventional light emitting unit, light from the unit is mostly directed in a downward direction, with considerably less light being directed in a horizontal direction. Examples of such conventional light emitting units include the "cobra" design and the "box" design.

In many instances however, it may be desirable to direct light, in both a generally horizontal and a downward direction. Thus, there is a problem in that conventional light emitting units do not provide the best light distribution in such instances.

Furthermore, for spaces in which both surveillance and illumination are required, and in particular, surveillance through a camera, conventional cameras are installed and directed toward particular target areas. Installation of such cameras is generally done separately from the illumination units serving the particular area. However, the surveillance cameras and the illumination units must be directed towards the target areas. Although installation, maintenance, and control of surveillance cameras and illumination units are done separately, they must be done such that target areas are both illuminated and monitored. Thus, there is a problem in that installation, maintenance, and control of such systems may be needlessly complex and costly.

In addition, conventional monitoring and surveillance cameras are generally installed in open areas so that cameras are visible from the target areas. Thus, there is a problem in that the visible presence of cameras may alert subjects of their presence and allow subjects being monitored to circumvent such surveillance.

Thus, there is a need for a lighting unit which improves upon the light distribution of conventional lighting units. There is also a need for a surveillance system which may be configured concurrently with a lighting unit serving a target area, and which does not alert target subjects of its presence.

SUMMARY OF THE INVENTION

Illustrative, non-limiting embodiments of the present invention, described below, help address the issues of lighting and/or surveillance. Since the scope of the appended claim defines the invention, however, it is not strictly necessary that an apparatus that falls within the claims solve any of the mentioned problems.

According to an aspect of the present invention, there is provided a light emitting apparatus including a housing, a plurality of inside chambers disposed on a perimeter of the housing, along a horizontal plane, each inside chamber of the plurality of inside chambers having an opening in an outward direction, a plurality of light emitting elements, wherein at least one light emitting element of the plurality of light emitting elements is disposed within each inside chamber of the plurality of inside chambers, a plurality of lenses, wherein each lens of the plurality of lenses is disposed at the opening of each inside chamber of the plurality of inside chambers, respectively, and wherein light emitted by the plurality of light emitting elements exits the plurality of inside chambers through the plurality of lenses outwardly in a horizontal and diagonally-downward direction.

The housing may further include an outside chamber formed at the front of the plurality of inside chambers, wherein an outer wall of the outside chamber includes a transparent perimeter cover, an inner wall of the outside chamber may be formed by the plurality of inside chambers, and an inner surface of an upper wall of the outside chamber may be reflective.

The plurality of inside chambers and the outside chamber may be disposed in only part of the perimeter of the housing, or may be disposed along the whole perimeter of the housing.

The attaching means may include a hollow elongated structure, and an end of the attaching means may be attached to the perimeter of the housing at a horizontal plane at a location in which inside chambers of the plurality of inside chambers and outside chambers are not disposed. In the alternative, the attaching means may be attached to the top of the housing.

The housing may have a hollow center, and the housing may have an opening at the bottom. The opening may be covered by a transparent bottom cover, the transparent bottom cover having a convex curvature extending downward from the housing. Within the hollow center, means for attaching a camera may be included.

The inside surfaces of the inside chambers may be reflective.

The light emitting element may be a light emitting diode.

The apparatus may further include a heater for heating the apparatus; and a blower for circulating air through the apparatus.

DETAILED DESCRIPTION OF EXEMPLARY EMBODIMENTS OF THE INVENTION

The present invention will now be described more fully with reference to the accompanying drawings, in which exemplary embodiments of the invention are shown. The invention may, however, be embodied in many different forms and should not be construed as being limited to the embodiments set forth therein; rather, these embodiments are provided so that this disclosure will be thorough and complete, and will fully convey the concept of the invention to those skilled in the art.

Figure 1:
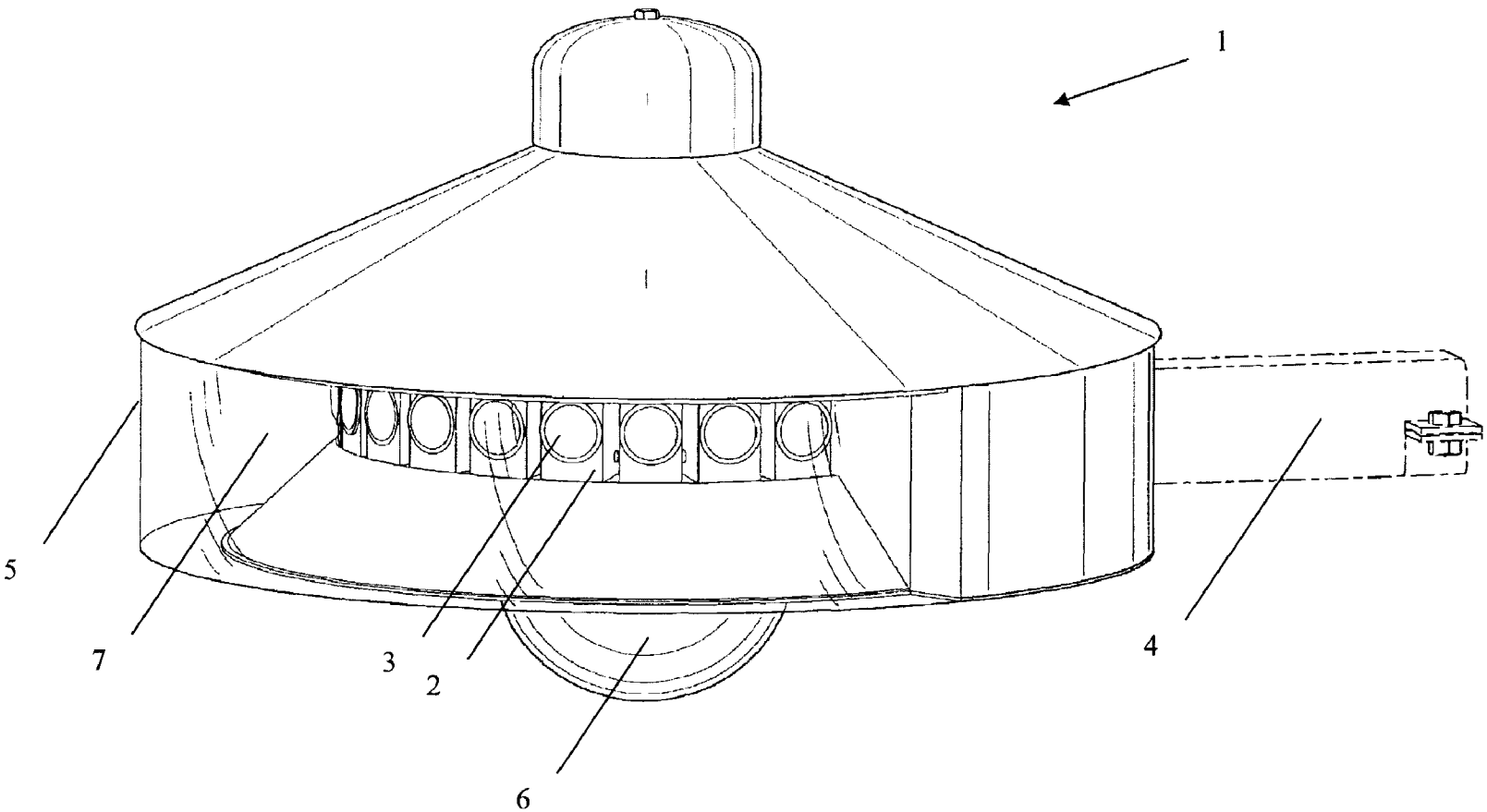
FIG. 1 shows a light emitting apparatus according to a first exemplary embodiment of the present invention.

FIG. 1 shows a light emitting apparatus according to a first exemplary embodiment of the present invention. In particular, FIG. 1 shows a housing 1, a transparent perimeter cover 5, an inside chamber 2, including a lens 3, an outside chamber 7, a transparent bottom cover 6, and attaching means 4.

In the first embodiment, a plurality of inside chambers 2 are disposed along a portion of the perimeter of the housing. As will be described later, light is generated at inside chambers 2 and is directed by lenses 3 outwardly towards outside chamber 7. Light passes through the outside chamber 7 and exits the housing unit 1 through transparent perimeter cover 5 outwardly with respect to the housing in a horizontal and diagonally-downward direction.

The first embodiment may be attached to a fixed structure (not shown), such as a light pole or the like, by means 4 such as a bracket, arm, or the like, any of which may be thought of as means for attaching the apparatus to a structure.

Figure 2:
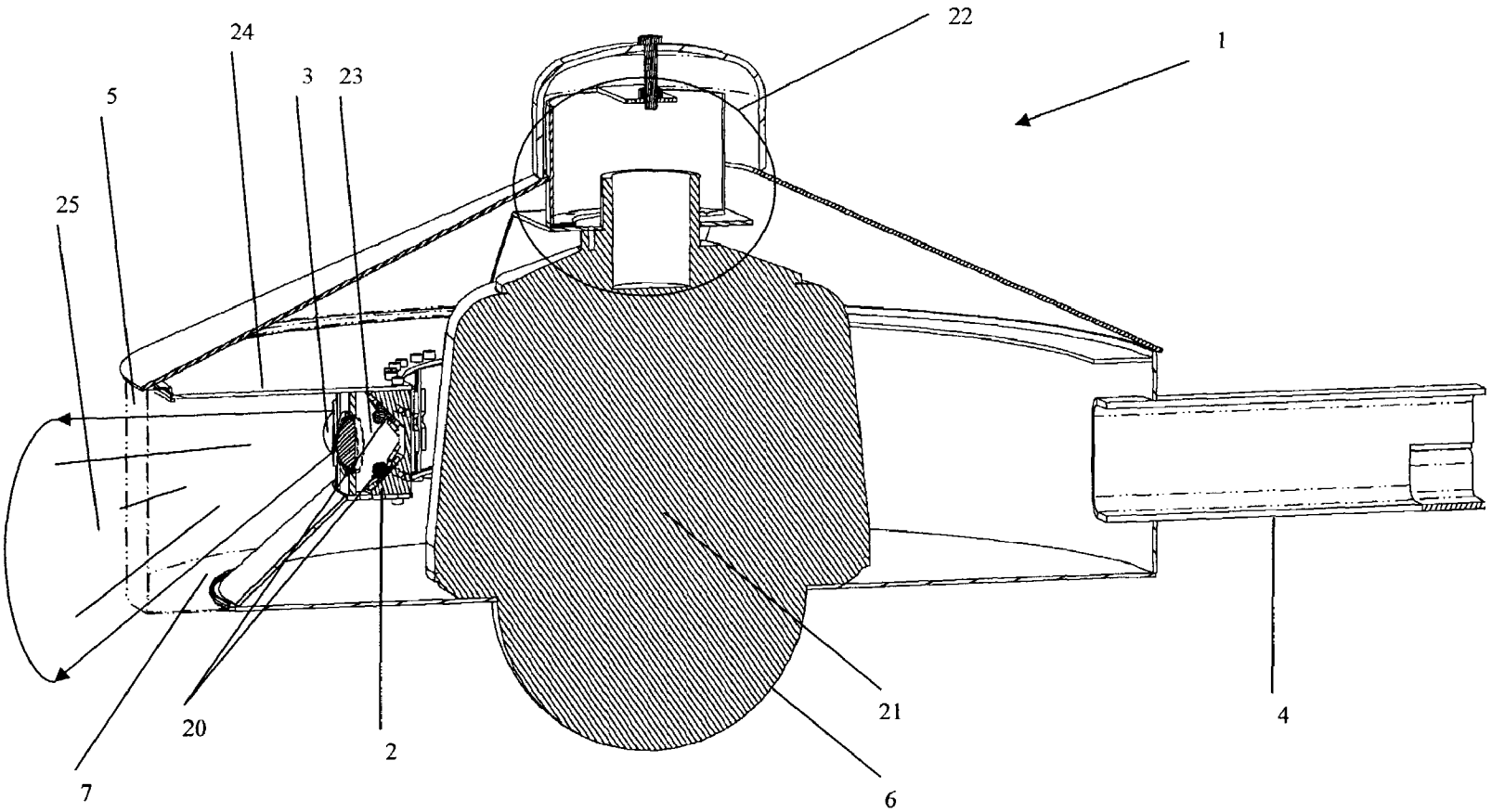
FIG. 2 shows a cross-sectional view of the first exemplary embodiment.

FIG. 2 shows a cross-sectional view of the first exemplary embodiment. In particular, FIG. 2 shows housing 1, means 22 for attaching a camera, and light emitting elements 20 within inside chamber 2. FIG. 2 also shows the upper wall 24 of outside chamber 7.

In this embodiment, inside chamber 2 includes two light emitting elements 20. When light emitting elements 20 emit light, light is reflected by the reflective inside walls 23 of inside chamber 2, and exits the inside chamber 2 through lens 3. Light may also exit the inside chamber 2 without being reflected off reflective inside walls 23 of inside chamber 2 (i.e., directly from the light emitting element towards the lens).

Light passes through the outside chamber 7 and exits the housing unit 1 through transparent perimeter cover 5 outwardly with respect to the housing in a horizontal and diagonally-downward direction 25.

A camera (not shown) may be disposed within hollow center 21 for surveillance purposes, and may be attached to housing 1 by means 22.

Attaching means 4 may include a hollowed center. Power and control lines (not shown) may reach the interior of housing 1 through the hollowed center of attachment means 4.

For attaching the camera, brackets of a wide variety of shapes may be used. Likewise, such a bracket may be formed integrally with other components. Any of these ways of attaching a camera to a fixed position in hollow center 21 may be thought of as means 22 for attaching a camera.

For generating light, Light Emitting Diodes (LED) may be used to reduce power consumption. However, a wide variety of light emitting elements may be used, such as mercury vapor lamps, fluorescent bulbs, halogen bulbs, ballasts lighting, flood and spot light lighting, incandescent lighting, high pressure sodium lamps, metal halide lamps, xenon bulbs, and cold cathode bulbs. Any of these light emitting elements may be thought of as light emitting elements 20.

Figure 4:
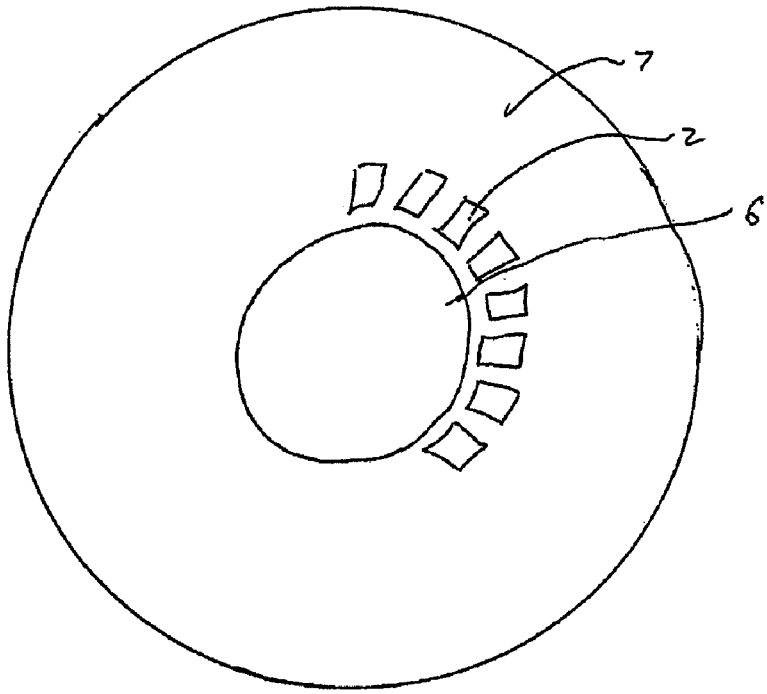
FIGS. 4A and 4B are schematic views showing exemplary configurations of the lighting chambers.
Figure 5:
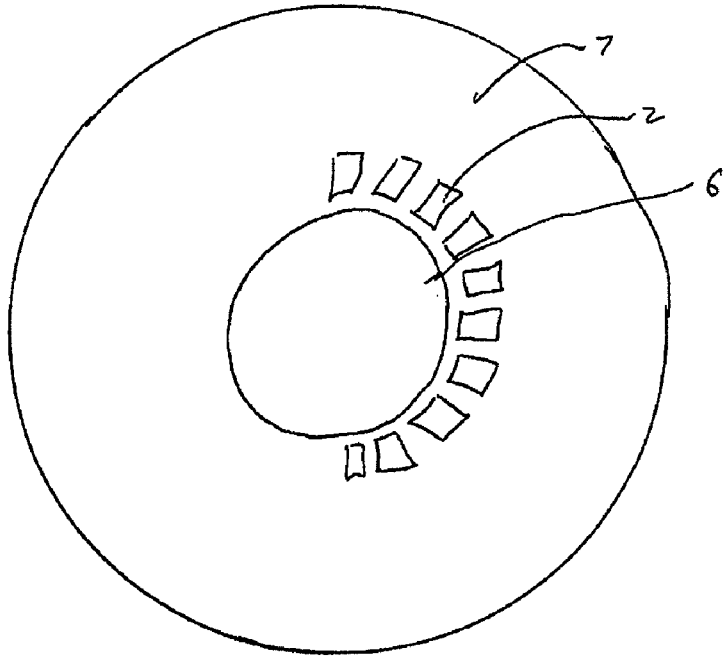

FIGS. 4A and 4B show exemplary configurations of the lighting chambers in which the inner chambers are disposed on no more than 180 degrees of the perimeter of the housing and on 180 degrees of the perimeter of the housing, respectively.

Figure 3:
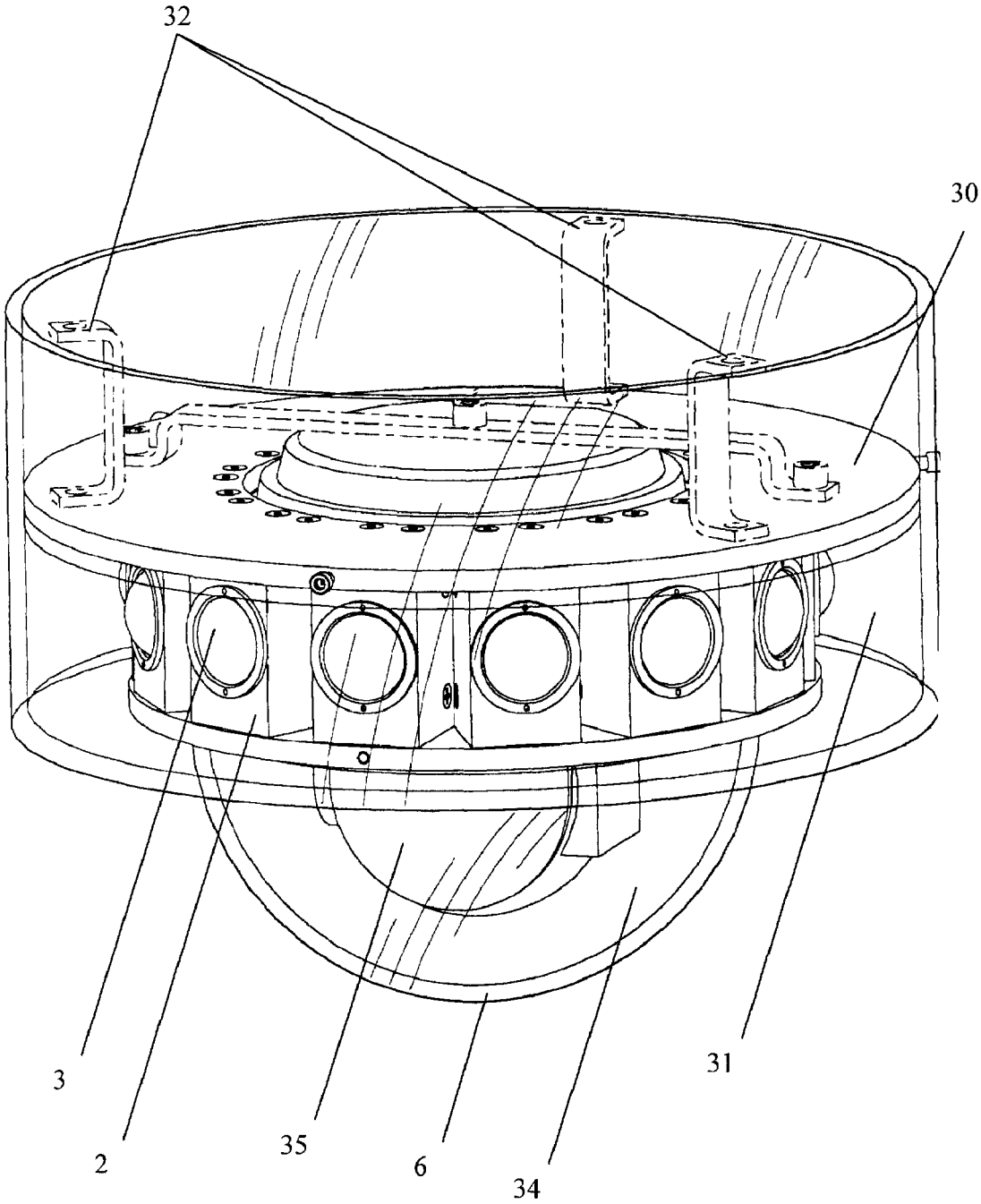
FIG. 3 shows a light emitting apparatus according to a second exemplary embodiment of the present invention.

FIG. 3 shows a light emitting apparatus according to a second exemplary embodiment of the present invention. In particular, FIG. 3 shows housing 1, means for attaching a camera 22 and light emitting elements 20 within inside chamber 2.

In the second embodiment, a plurality of inside chambers 2 are disposed along the perimeter of housing 30. Light is generated at the inside chambers 2, as previously described, and directed by lenses 3 outwardly from housing 30. Light passes through the outside chamber 31 and exits the housing unit 30 through transparent perimeter cover 33.

The second embodiment may be attached to a fixed structure (not shown), such as a wall, ceiling, or the like, by attachment means 32, disposed on top of the housing 30.

A camera 35 may be disposed within hollow center 34 for surveillance purposes, and may be attached to housing 30 by means 22 for attaching a camera.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A light emitting apparatus comprising:

a housing;

a plurality of light emitting elements disposed in said housing, wherein light emitted by said plurality of light emitting elements is directed outwardly in a horizontal and diagonally-downward direction;

a plurality of discrete housing modules, each housing module forming an inside chamber and including peripheral walls projecting outward, the plurality of discrete housing modules disposed on a perimeter of said housing along a horizontal plane and aligned in a circumferential direction, each inside chamber of said plurality of inside chambers having an opening in an outward direction; and a plurality of lenses, wherein each lens of said plurality of lenses is disposed at the opening of each inside chamber of said plurality of inside chambers, respectively, wherein at least one light emitting element of said plurality of light emitting elements is disposed within each inside chamber of said plurality of inside chambers; and a camera provided at a bottom of the housing.

2. The apparatus of claim 1, wherein the camera is a surveillance camera.

3. The apparatus of claim 1, further comprising:

a transparent bottom cover disposed at the bottom of said housing, said transparent bottom cover being configured to cover a bottom opening of said housing and having a curvature extending downward from said housing.

4. The apparatus of claim 3, further comprising means for attaching the camera within a hollow center of said housing.

5. The apparatus of claim 1, wherein said housing has a hollow center, and wherein said housing has an opening at the bottom.

6. The apparatus of claim 5, further comprising:

a transparent bottom cover disposed at the bottom of said housing, said transparent bottom cover being configured to cover the bottom opening of said housing and having a curvature extending downward from said housing.

7. The apparatus of claim 6, further comprising means for attaching the camera within the hollow center of said housing.

8. A light emitting apparatus comprising:

a housing;

a plurality of light emitting elements disposed in said housing, wherein light emitted by said plurality of light emitting elements is directed outwardly in a horizontal and diagonally-downward direction;

a plurality of discrete housing modules, each housing module forming an inside chamber and including peripheral walls projecting outward, the plurality of discrete housing modules disposed on a perimeter of said housing along a horizontal plane and aligned in a circumferential direction, each inside chamber of said plurality of inside chambers having an opening in an outward direction; and a plurality of lenses, wherein each lens of said plurality of lenses is disposed at the opening of each inside chamber of said plurality of inside chambers, respectively, wherein at least one light emitting element of said plurality of light emitting elements is disposed within each inside chamber of said plurality of inside chambers; and an outside chamber formed at the front of said plurality of inside chambers, wherein an outer wall of said outside chamber comprises a transparent perimeter cover, wherein an inner wall of said outside chamber is formed by said plurality of inside chambers, and wherein an inner surface of an upper wall of said outside chamber is reflective.

9. The apparatus of claim 8, wherein said plurality of inside chambers and said outside chamber are disposed on no more than 180 degrees of the perimeter of said housing.

10. The apparatus of claim 8, wherein said plurality of inside chambers and said outside chamber are disposed on more than 180 degrees of the perimeter of said housing.

11. The apparatus of claim 8, wherein the inside surface of said inside chambers is reflective.

12. The apparatus of claim 8, wherein the light emitting element comprises a light emitting diode.

13. The apparatus of claim 8, wherein said plurality of inside chambers and said outside chamber are disposed on 180 degrees of the perimeter of said housing.

14. The apparatus of claim 3, said housing further comprising attaching means comprising a hollow elongated structure, and wherein an end of said attaching means is attached to the perimeter of said housing at a horizontal plane at a location in which inside chambers of the plurality of inside chambers and outside chambers are not disposed.

15. The apparatus of claim 8, wherein said plurality of inside chambers and said outside chamber are disposed on 360 degrees of the perimeter said housing.

16. The apparatus of claim 15, said housing further comprising attaching means being at the top of said housing.

17. The apparatus of claim 8, further comprising a camera provided at a bottom of the housing.

18. The apparatus of claim 17, wherein the camera is a surveillance camera.

19. The apparatus of claim 17, further comprising:

a transparent bottom cover disposed at the bottom of said housing, said transparent bottom cover being configured to cover a bottom opening of said housing and having a curvature extending downward from said housing.

20. The apparatus of claim 19, further comprising means for attaching the camera within a hollow center of said housing.

* * * * *